US008167012B2

(12) United States Patent
Hicks et al.

(10) Patent No.: US 8,167,012 B2
(45) Date of Patent: May 1, 2012

(54) KNOCK-DOWN FOUNDATION FOR A BED

(75) Inventors: Shawn Hicks, Trenton (CA); Knud Jensen, Markdale (CA)

(73) Assignee: Pine Ridge Forest Products, Inc., Cobourg, Ontario (CA)

( * ) Notice: Subject to any disclaimer, the term of this patent is extended or adjusted under 35 U.S.C. 154(b) by 160 days.

(21) Appl. No.: 12/662,144

(22) Filed: Mar. 31, 2010
(Under 37 CFR 1.47)

(65) Prior Publication Data

US 2011/0155284 A1 Jun. 30, 2011

Related U.S. Application Data

(63) Continuation-in-part of application No. 12/155,150, filed on May 30, 2008, now abandoned.

(30) Foreign Application Priority Data

May 31, 2007 (CA) ..... 2591327

(51) Int. Cl.
*B27M 1/00* (2006.01)

(52) U.S. Cl. ..... 144/329; 144/364; 144/380

(58) Field of Classification Search ..... 144/329, 144/348, 352, 364, 380; 5/201, 282.1, 285, 5/400

See application file for complete search history.

(56) References Cited

U.S. PATENT DOCUMENTS

| | | | | | |
|---|---|---|---|---|---|
| 139,092 | A * | 5/1873 | Urie | 403/292 |
| 2,377,156 | A * | 5/1945 | Kimbell | 403/297 |
| 2,432,379 | A * | 12/1947 | Butler | 5/2.1 |
| 4,125,912 | A * | 11/1978 | Courter | 5/400 |
| 4,319,370 | A * | 3/1982 | Robinson | 5/201 |
| 4,391,008 | A * | 7/1983 | Yamaoka et al. | 5/200.1 |
| 4,402,097 | A * | 9/1983 | Scott | 5/181 |
| 4,617,689 | A * | 10/1986 | Nelson et al. | 5/400 |
| 4,734,946 | A * | 4/1988 | Saputo | 5/400 |
| 4,788,727 | A * | 12/1988 | Liu | 5/679 |
| 4,901,383 | A * | 2/1990 | Yang et al. | 5/201 |
| 4,948,199 | A * | 8/1990 | Weller | 297/472 |
| 5,144,706 | A * | 9/1992 | Walker | 5/400 |
| 5,469,589 | A * | 11/1995 | Steed et al. | 5/400 |
| 5,564,140 | A * | 10/1996 | Shoenhair et al. | 5/400 |
| 6,219,863 | B1 * | 4/2001 | Loberg et al. | 5/236.1 |
| 6,585,448 | B2 * | 7/2003 | Grossman et al. | 403/403 |
| 6,832,397 | B2 * | 12/2004 | Gaboury et al. | 5/201 |
| 6,883,191 | B2 * | 4/2005 | Gaboury et al. | 5/201 |
| 6,978,498 | B2 * | 12/2005 | Vazquez | 5/400 |
| 7,003,822 | B1 * | 2/2006 | Sheehy | 5/201 |
| 2005/0235417 | A1 * | 10/2005 | Koughan et al. | 5/400 |

* cited by examiner

*Primary Examiner* — Shelley Self

(57) ABSTRACT

The foundation includes an assembly of wooden components which interconnect to form an enclosed rectangular configuration for supporting a mattress. At each corner of the assembly are two posts which are interconnected by dowels or by a tongue and groove. The dowels and the mouths of the openings in which they are accommodated are bevelled for facilitating the insertion of the dowels into the openings should they be misaligned. The tongues and grooves are also bevelled for the same reason. The wooden components are subject to compressive forces and to a heat treatment before being assembled into the foundation.

8 Claims, 6 Drawing Sheets

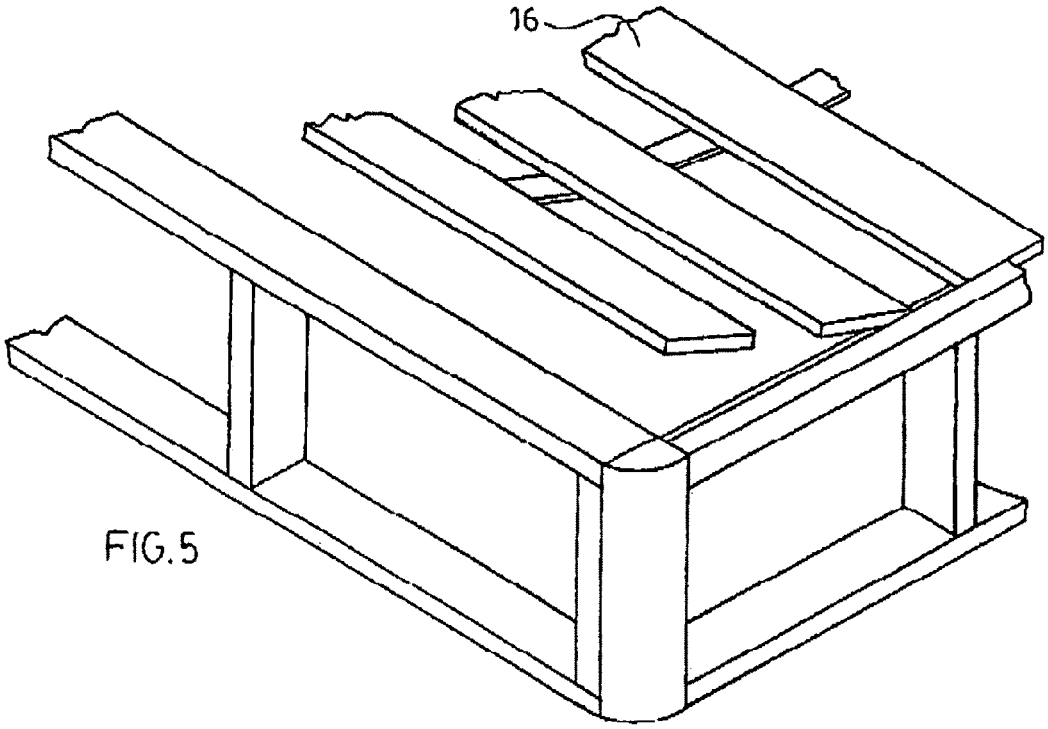
FIG. 5
FIG. 6
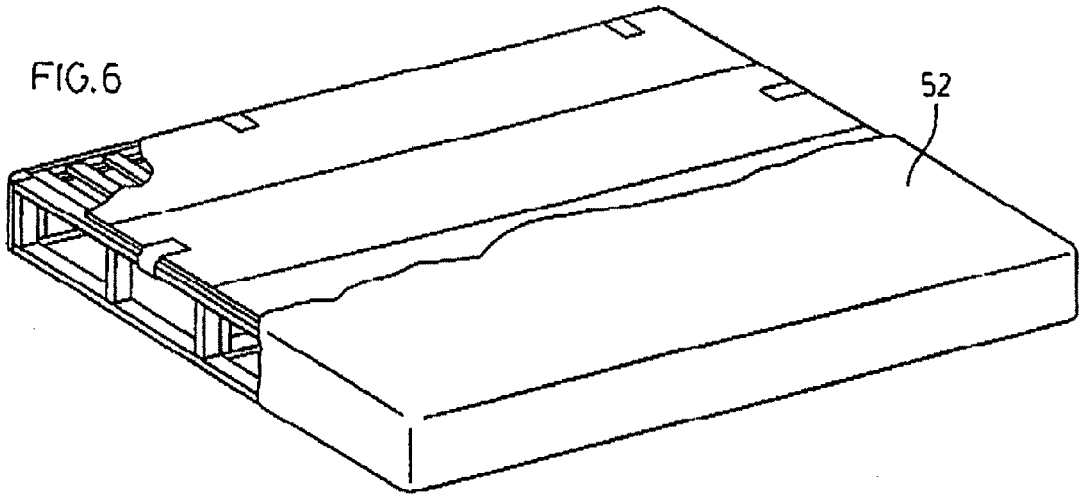

KNOCK-DOWN FOUNDATION FOR A BED

This application is a Continuation-In-Part of application Ser. No. 12/155,150 filed on May 30, 2008 now abandoned.

FIELD OF THE INVENTION

This invention relates to foundations for beds and more particularly to a knock-down foundation composed of an assembly of wooden components which interconnect to form an enclosed rectangular configuration for supporting a mattress.

BACKGROUND OF THE INVENTION

Mattresses are conventionally supported by a foundation such as a box spring or metallic springs. Larger beds such as king and queen sized beds require foundations which because of their relatively large size, are heavy and awkward to handle. In addition to this shortcoming, after the usefulness of a foundation has ended, it cannot be recycled but must, at cost and inconvenience be transported and disposed of at land-fill sites.

We have invented a knock-down foundation for a bed that can be easily assembled for use and dismantled for transport or disposal. The foundation is composed almost entirely of wood that is suitable for recycling or readily compostable at the end of its useful life. Where possible, pieces of wood which make up the foundation are interconnected by wooden dowels or tongues and grooves. Non-compostable material such as bolts and screws are kept to a minimum.

The foundation of out invention has other advantages generally not shared by conventional foundations. The wooden components of our foundation are designed to hold tightly together to minimize the number of gaps between adjacent parts. Gaps are undesirable because rubbing of the components of the foundation separated by the gaps occurs when there is movement on the foundation. Such rubbing produces undesirable squeaks, rattles and other undesirable noises.

Another advantage of our foundation is that the parts are designed to be assembled using power tools such as pneumatic presses in order to speed up the process of assembly. To this end, dowels and tongues used to interconnect the parts are preferably bevelled in order to align automatically with the openings or grooves in which they are inserted as they are pressed together.

SUMMARY OF THE INVENTION

Briefly the foundation of our invention consists of an assembly of wooden components including: longitudinal elements on opposite sides thereof; front and rear transverse elements at opposite ends thereof and means for supporting a mattress. Each longitudinal element has at least one longitudinal stringer and side posts at opposite ends thereof and each transverse element has at least one crosspiece and end posts at opposite ends thereof. Each side post is disposed adjacent to a separate end post to form a pair of posts. The foundation has means for interconnecting each pair of posts in order to arrange the stringers and crosspieces into an enclosed rectangular configuration.

DESCRIPTION OF THE DRAWINGS

The knock-down foundation of the invention is described with reference to the accompanying drawings in which:

FIG. 5 is a perspective view of several slats together with portions of a crosspiece and a stringer;

FIG. 6 is a perspective view of the framework of the foundation partially concealed by ticking;

Like reference characters refer to like parts throughout the description of the drawings.

DESCRIPTION OF PREFERRED EMBODIMENTS OF THE FOUNDATION

Figure 1:
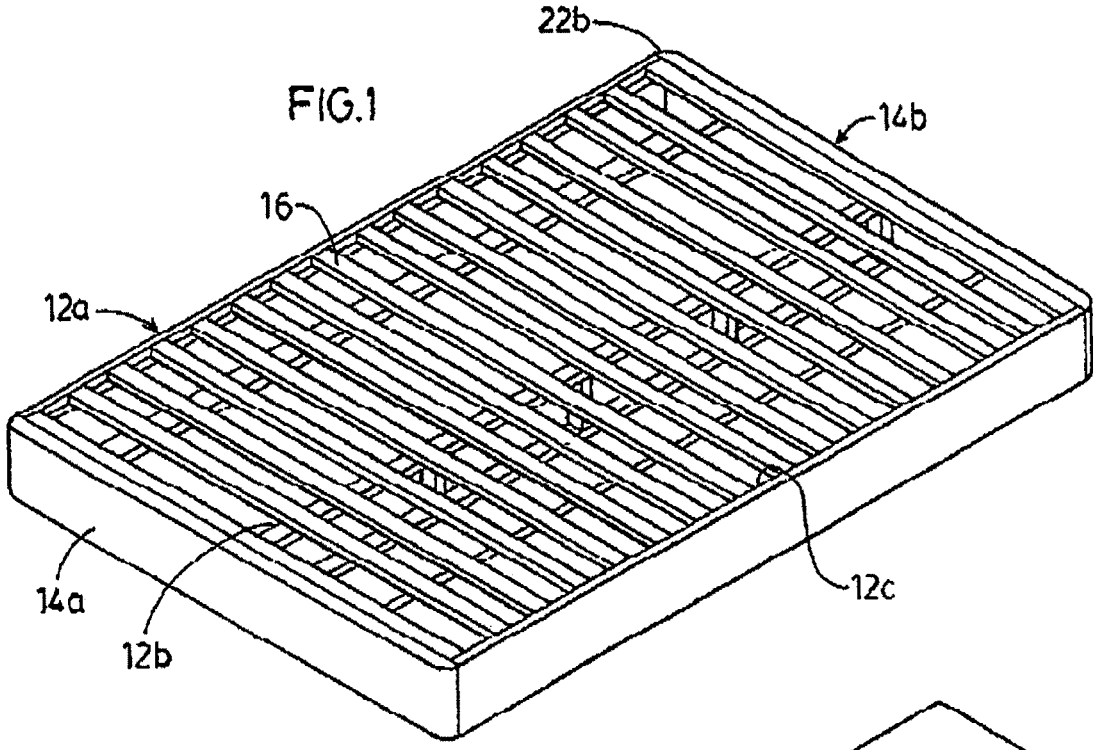
FIG. 1 is a perspective view of the interior of the foundation.
Figure 2:
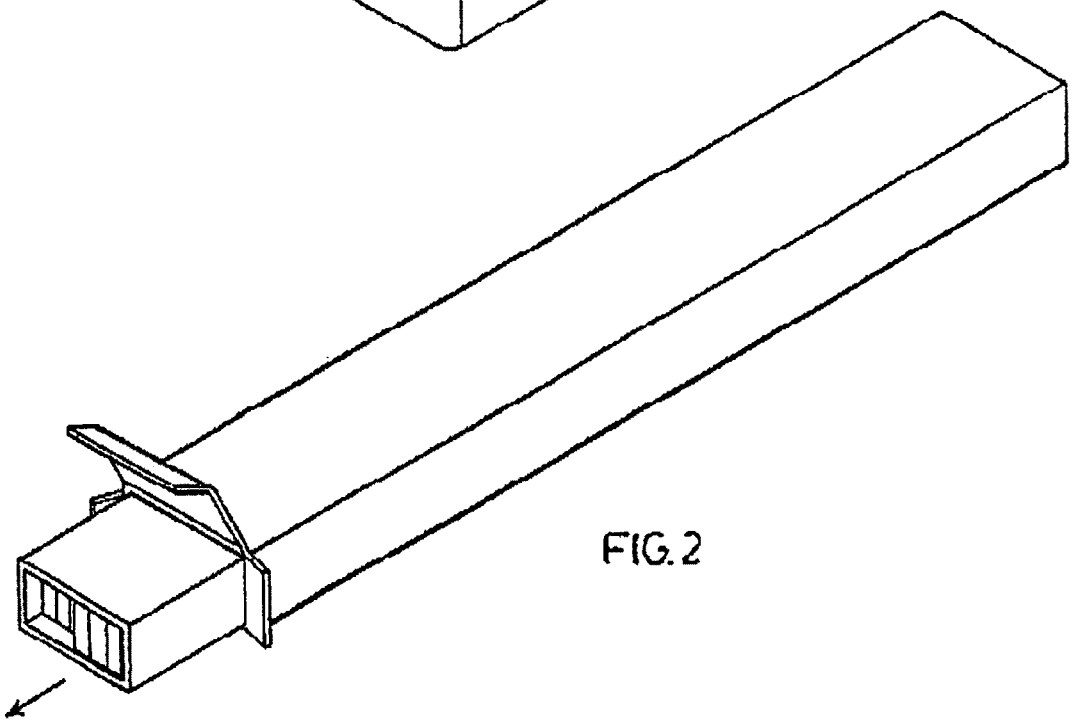
FIG. 2 is a perspective view of the components of the foundation prior to assembly packed in a shipping container.
Figure 3:
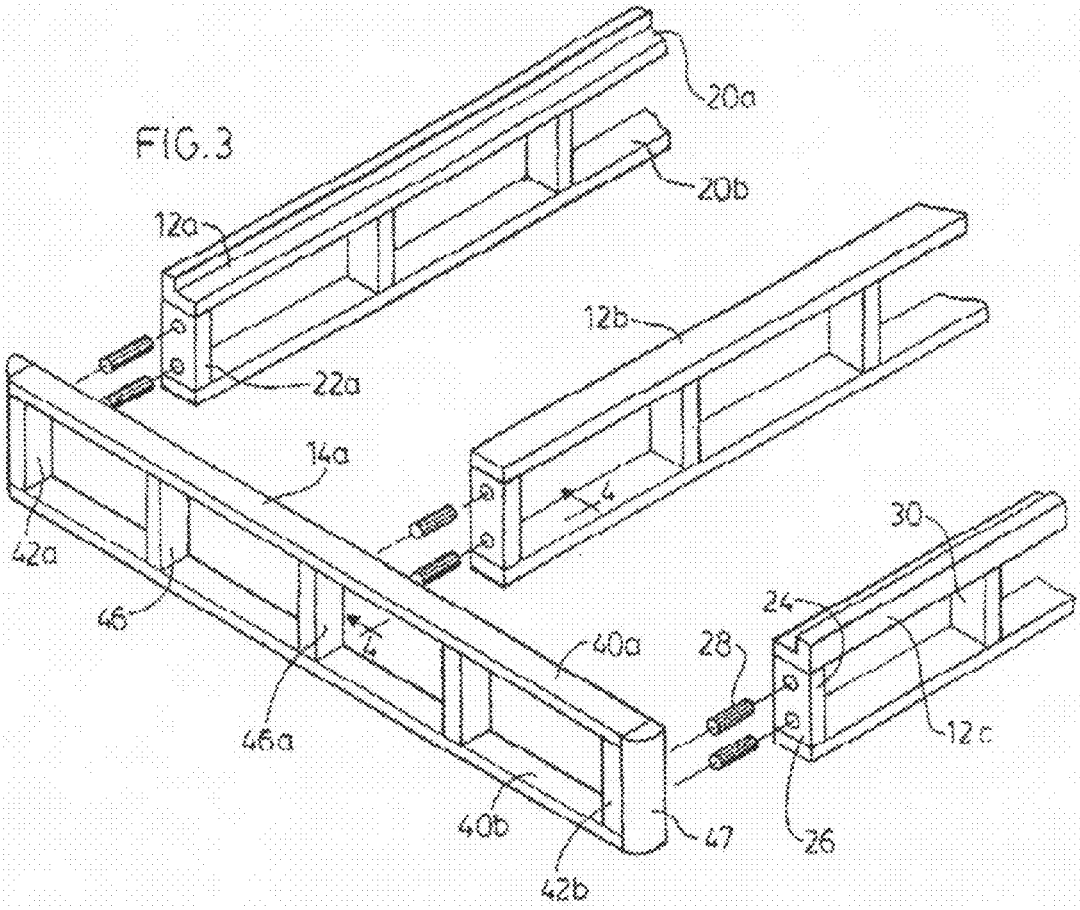
FIG. 3 is a perspective view of a crosspiece and portions of two stringers of the foundation prior to interconnection.

With reference to FIGS. 1 and 3 the foundation is made up of an assembly of wooden components which include three parallel longitudinal elements generally 12*a,b* and *c* and a pair of front and back transverse elements generally 14*a,b*, respectively. Slats 16 support a mattress (not illustrated). The interconnected longitudinal and transverse elements together define an enclosed rectangular configuration.

Each longitudinal element is composed of a pair of upper and lower stringers 20*a,b* respectively. The stringers are longitudinally extending and are of equal length. The stringers are maintained in a spaced parallel relationship by a pair of parallel side posts 22*a,b* which interconnect the ends of the two stringers. A number of spacers 30 are disposed between the side posts 22*a,b* and also serve to maintain the longitudinal stringers in a spaced parallel relationship.

The side posts have inner and outer walls 24, 26 walls, respectively. The inner walls face each other while the outer walls are oppositely facing. A pair of spaced apart dowels 28 are accommodated in openings in the outer walls and extend outwardly therefrom.

The front and back transverse elements of the foundation are each made up of a pair of upper and lower crosspieces 40*a,b* respectively of equal length. The crosspieces are maintained in a parallel relationship by a pair of parallel end posts 42*a,b* at opposite ends of the crosspieces. A number of spacers 46 are disposed between the side posts. Outside of the end posts is a half round piece 47 for decoration and protection to the end posts and to persons in the vicinity of the foundation.

The posts and spacers are be attached to the stringers and transverse elements by nails, staples or screws. Alternatively they can be attached by dowels or by tongues and grooves.

The longitudinal elements of the foundation are spaced apart an equal distance. The two outer longitudinal elements 12*a,c* define the side walls of the foundation while the third longitudinal element 12*b* lies between the other two and provides support to the foundation midway between its sides.

Figure 4:
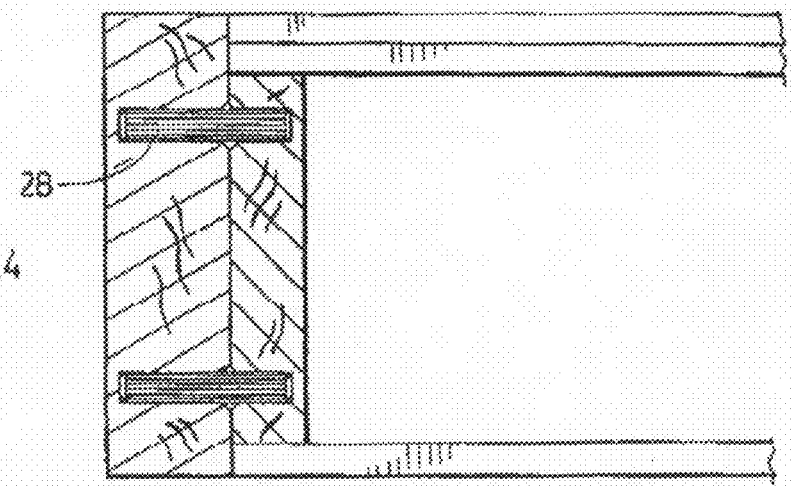
FIG. 4 is a plan view, partly cut away, of the components illustrated in FIG. 3 after interconnection.

With reference to FIGS. 3 and 4, the end posts 42*a,b* have a pair of apertures which admit dowels 28 for securing the two outer longitudinal elements 12*a,c* to the front and back transverse elements. The dowels in the third longitudinal component 12*b* fit into apertures in a central spacer 46*a* in each transverse element.

With reference to FIG. 5, slats 16 extend between the two outer longitudinal elements and are arranged parallel to each other. With reference to FIG. 6, ticking 52 is placed over the entire assembly to conceal the framework of the foundation.

Figure 7:
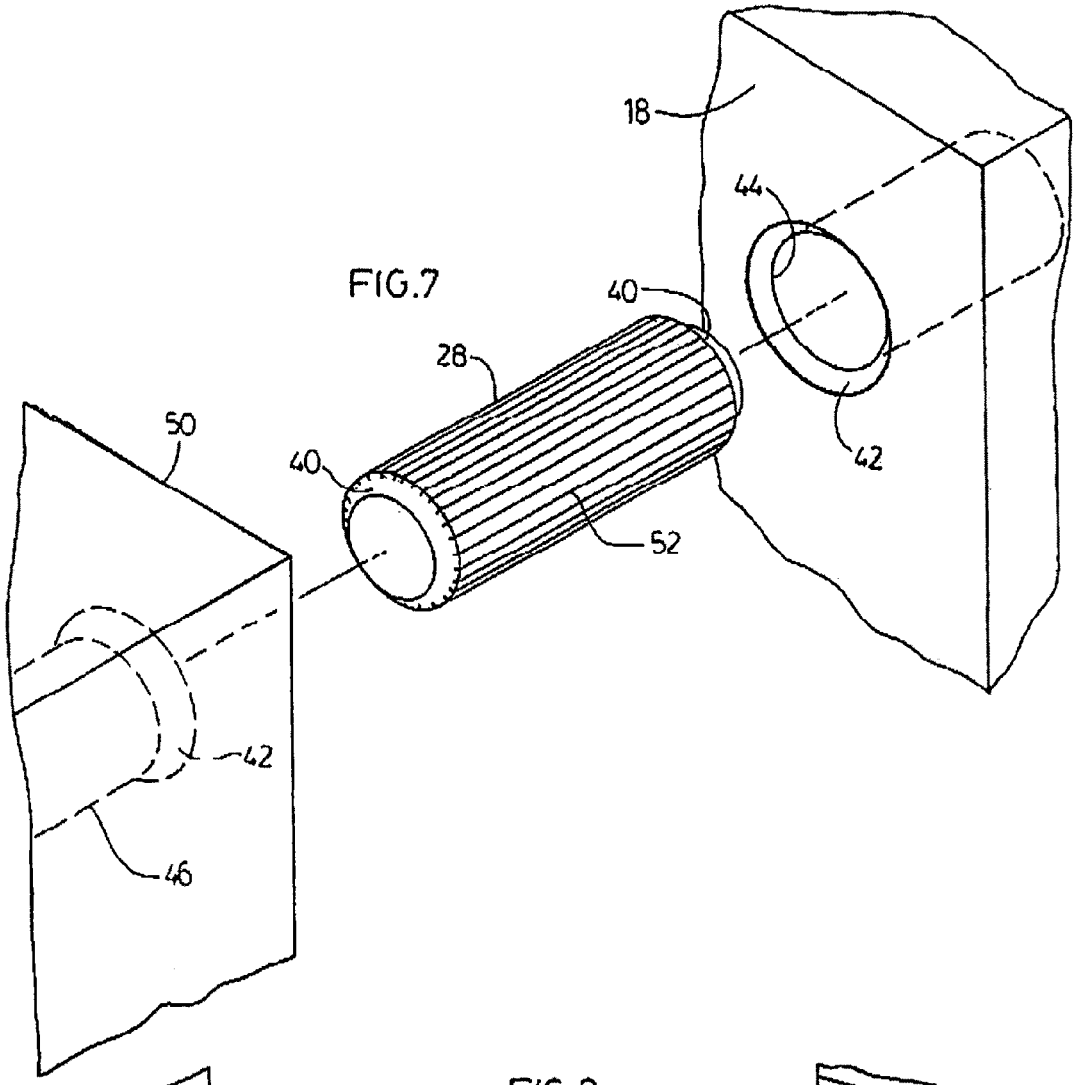
FIG. 7 is an perspective view, in larger scale, of portions of two posts and a dowel for interconnecting the posts.
Figure 8:
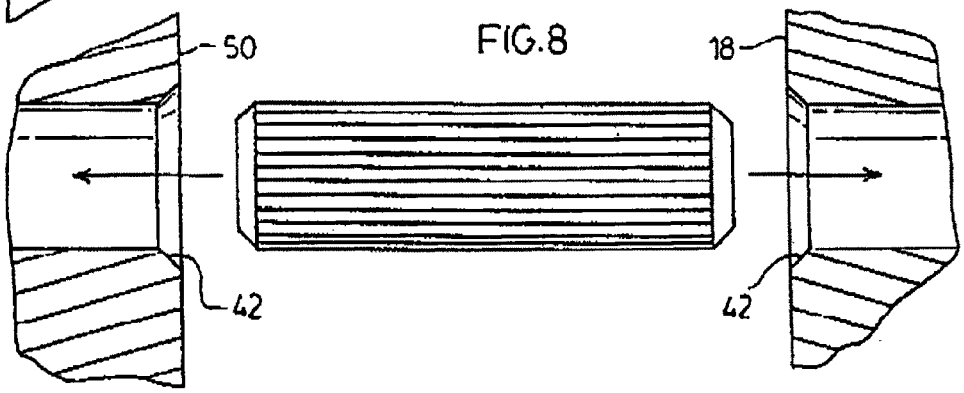
FIG. 8 is an elevation of the components illustrated in FIG. 7.

With reference to FIGS. 7 and 8, both ends of dowel 28 are bevelled at 40 as are the mouths 42 of the openings 44, 46 of end post 48 and side post 50, respectively, in which the dowel is pressure fitted. The dowel may be slightly misaligned with openings 44, 46 before the dowel is forced into the openings. Bevels are provided to ensure that the dowel aligns automatically with the openings as pressure to the posts to bring them into contact with each other. The pressure may be applied by a power tool such as a pneumatic press.

Longitudinally extending grooves 52 are formed in the cylindrical outer wall of the dowel. The grooves are provided to improve the bond between the dowel and the walls of the openings when the dowel is glued in the openings. Glue may be used when the bond between the dowel and the walls of an opening is to be permanent.

Figure 9:
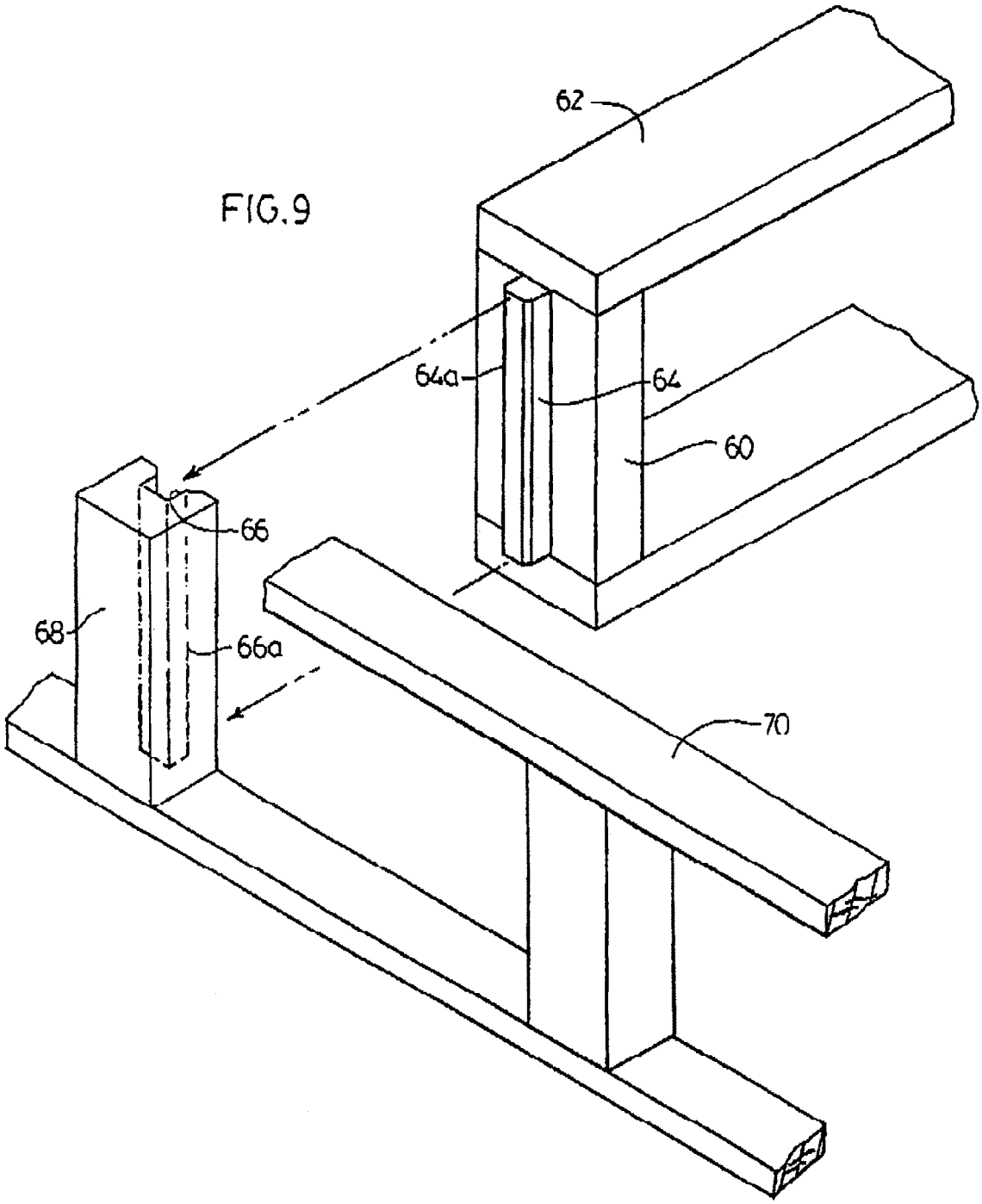
FIG. 9 is a perspective view of portions of a stringer and a crosspiece together with two posts, one provided with a tongue and the other with a groove, for interconnecting the two posts.

With reference to FIG. 9, post 60 of longitudinal element 62 is provided with a tongue 64 which pressure fits into a groove 66 formed in post 68 of transverse elements 70. The tongue and groove serves the same purpose of the dowel of the previous figures. The side edges 64*a* of the tongue are bevelled as are the side edges 66*a* of the groove to facilitate alignment of the two posts as they are being forced together during the process of assembly of the foundation.

The components of the foundation are formed of wood, preferably spruce, pine or fir. Such wood commonly has latent defects which, over time, appear in the finished foundation. The defects may result in checks and splits in the wood and cause undesirable results such as splinters and gaps between adjacent components of the foundation. If there are splinters, they can, of course cause injury to a person who lies on a mattress on top of the foundation. If there are gaps, any movement on the mattress may cause undesirable noises such as squeaks and rattles resulting from rubbing together of the walls of the gaps.

Figure 10:
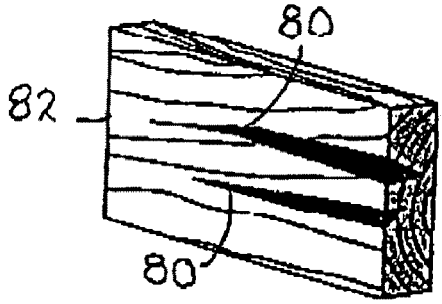
FIGS. 10 and 11 are perspective views of pieces of lumber.
Figure 11:
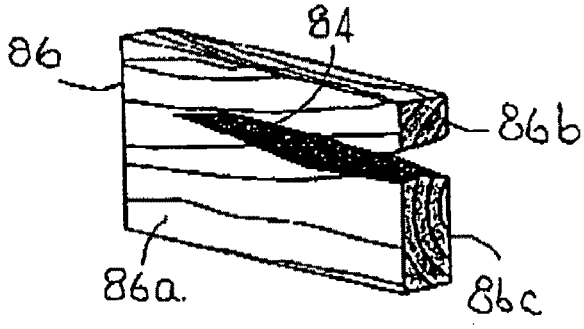

In FIG. 10, two checks 80 are formed in a length of lumber 82. A check is a separation in the wood that may occur in one or two surfaces of a board and may extend through its entire thickness. Normally checks occur lengthwise across the annual growth rings of the lumber. In FIG. 11, a split 84 is formed in a length of lumber 86. A split is generally a lengthwise separation of the wood through three surfaces 86*a, b, c* and usually results from a tearing apart of the cells in the wood.

We have found that if the wood which is to be used in the foundation is pre-dried i.e. is dried before it is assembled into the foundation, defects not apparent in the wood at the time of assembly cause, in many cases, fewer checks and splits in the finished foundation. Even if checks and splits do form in the finished foundation, they are relatively minor and have negligible affect on the overall quality of the finished foundation. In other cases, no checks and splits form at all in the foundation despite the fact that the wood has latent defects.

In all cases, pre-drying of wood which has latent defects results in an improved quality of foundation. Not only does pre-drying reduce checks and cracks but also it reduces shrinkage. Shrinkage is undesirable because a foundation that is stable before shrinkage can become unstable after shrinkage.

Prior to pre-drying, the wood is preferably subject to compressive forces which can be carried out in various ways but preferably is carried out by assembling the wood, which typically is in the form of various lengths of dimensional lumber into bundles. The bundles are then bound together by means of metallic bands or strips and are stressed by means of a compressive force applied vertically and horizontally at a number of locations along the length of the bundle. The location and number of stressed points will depend on the desired properties of the finished foundation such as whether it is composed of low or high quality wood, its appearance, its strength, its weight and so on. The location and number of stressed points will also depend on the dimensions of the finished foundation.

The horizontal compressive force can be as high as 400 psi but typically is no higher than about 250 psi. A formula that has been developed thr determining an appropriate horizontal compressive force or stress ("hcf") is as follows:

$$\text{hcf}=ab/cd$$

where:

a=ultimate breaking strength of the band (typically from about 100,000 to 140,000 psi)

b=cross-sectional area of the band (sq. inches)

c=the width of the bundle (inches)

d=width of the band at which the compressive force is applied (inches)

An appropriate vertical compressive force ("vcf") can be calculated as follows:

$$\text{vcs}=ab/fd$$

where f=the height of the bundle (inches); and a, b, d being the same as above

After the bundle has been pre-stressed it is loaded into au oven or a kiln into which steam is introduced under a relatively low pressure and at a temperature in the range of about 250 to about 750 degrees F. In the oven or kiln, the bundle including all of its components is heated to a temperature preferably in the range between about 132 to about 257 degrees F. The bundle is held at that temperature for not less than about 1 hour but typically for about 12 hours. In some cases however the heat treatment can last as long as 120 hours.

An appropriate temperature for the heat treatment process can be calculated as follows:

$$T(\text{degrees F.})=180+e^{gh}$$

where:

e=base of natural logarithms (approx. 2.71828)

g=Spacing Stick Factor. Spacing-sticks are used to separate adjacent pieces of lumber and may be placed between adjacent pieces in each layer or between pieces in every other layer. The factor varies between 0.1 and 1.0 and depends upon whether the sticks are between each layer or between every other layer in a bundle. The factor also depends on the thickness of the sticks.

h=cross-sectional area of each piece of timber in the bundle (sq. inches)

An appropriate time for the heat treatment process can be calculated as follows:

$$T(\text{time in minutes})=60+b$$

where b=cross-sectional area of the bundle within a band (sq. inches)

It will be understood, of course, that modifications can be made in the structure of the foundation and the pressure and heat treatments described herein without departing from the scope and purview of the invention as defined in the appended claims.

We claim:

1. A method of production of a wooden bed foundation having longitudinal elements on opposite sides thereof and front and rear transverse elements at opposite ends thereof, said method including the following steps prior to assembly of said bed foundation: (i) providing wooden elements for said bed foundation; (ii) applying a compressive force to said elements; and (iii) heating said elements to a temperature in the range of from about 132 degrees F. to about 257 degrees F. and maintaining said heated elements at said temperature for a period of less than about 1 hour.

2. The method of claim 1 wherein said compressive force of step (ii) is applied both horizontally and vertically.

3. The method of claim 1 wherein said compressive force of step (ii) is not more than about 250 psi.

4. The method of claim 1 wherein said compressive force of step (ii) is in the range of about 250 to shout 400 psi.

5. The method of claim 2 including the step between said step (i) and said step (ii) of:

(ia) binding said elements into bundles by means of a metallic band;

and wherein said horizontal compressive force ("hcf") is calculated by means of the formula:

$$\text{hcf}=ab/cd$$

where:

a=ultimate breaking strength of said band (psi)

b=cross-sectional area of said band (sq. inches)

c=the width of said bundle (inches)

d=width of said band at which said compressive force is applied (inches).

6. The method of claim 2 including the step between said step (i) and said step (ii) of:

(ia) binding said elements into bundles by means of a metallic band;

and wherein said vertical compressive force ("vcf") is calculated by means of the formula $$\text{vcf}-ab/hd$$

where h=the height of said bundle (inches);

a=ultimate breaking strength of said band (psi)

b=cross-sectional area of said band (sq. inches)

d=width of said band at which said compressive force is applied (inches).

7. The method of claim 1 wherein said temperature of step (iii) is calculated according to the formula:

$$T(\text{degrees F.})=180+e^{gh}$$

where:

e=base of natural logarithms g=Spacing Stick Factor h=cross-section area of each said element in said bundle (inches).

8. The method of claim 1 including the step between said step (i) and said step (ii) of:

(ia) binding said elements into bundles by means of a metallic band;

and wherein said heated element of step (iii) is maintained at said temperature for a period calculated according to the formula:

$$T(\text{time in hours})=60+b$$

where b—cross-sectional area of said bundle within said band (sq. inches).

* * * * *